United States Patent [19]

Doran

[11] Patent Number: 4,577,447

[45] Date of Patent: Mar. 25, 1986

[54] CONSTRUCTION BLOCK

[76] Inventor: William E. Doran, 524 Via Almar, Palos Verdes Estates, Calif. 90274

[21] Appl. No.: 503,358

[22] Filed: Jun. 10, 1983

Related U.S. Application Data

[63] Continuation-in-part of Ser. No. 310,797, Oct. 13, 1981.

[51] Int. Cl.[4] ..... E04B 1/12; E04B 2/00; E04C 1/04

[52] U.S. Cl. ..... 52/571; 52/569; 52/570; 52/572; 52/426; 52/430

[58] Field of Search ..... 52/569, 570, 571, 572, 52/426, 424, 430, 436; 446/120, 122, 124, 125, 128

[56] References Cited

U.S. PATENT DOCUMENTS

| | | | |
|---|---|---|---|
| Re. 17,291 | 5/1929 | Munson | 52/430 |
| 1,208,785 | 12/1916 | Hunn | 52/430 |
| 1,434,612 | 11/1922 | Hamilton | 52/436 |
| 3,220,151 | 11/1965 | Goldman | 52/430 |
| 4,147,007 | 4/1979 | Eppich | 52/570 |

FOREIGN PATENT DOCUMENTS

| | | | |
|---|---|---|---|
| 87872 | 9/1983 | European Pat. Off. | 52/572 |
| 187411 | 7/1907 | Fed. Rep. of Germany | 52/430 |
| 1015169 | 8/1952 | France | 52/572 |
| 591067 | 9/1947 | United Kingdom | 52/572 |
| 2074461 | 11/1981 | United Kingdom | 446/125 |

*Primary Examiner*—Donald G. Kelly
*Assistant Examiner*—Michael Safavi
*Attorney, Agent, or Firm*—Jack C. Munro

[57] ABSTRACT

A building block to be used in the construction of houses, buildings, gargages, sheds and the like, which is constructed of expanded, polystyrene beads. The building block is to be arranged with other similar building blocks in a vertically orientated, horizontally staggered relationship. Each building block is constructed of two parts which are adhesively secured together in a facing relationship. Each building block includes a pair of vertically aligned openings. When the building block is in the assembled, stacked relationship with other similar building blocks, there are a series of horizontally aligned openings to permit the conducting of rigid reinforcing rods between the blocks. Each building block includes within its upper surface and lower surface interlocking structure which is to interlock with other similar blocks when located in the stacked relationship.

3 Claims, 15 Drawing Figures

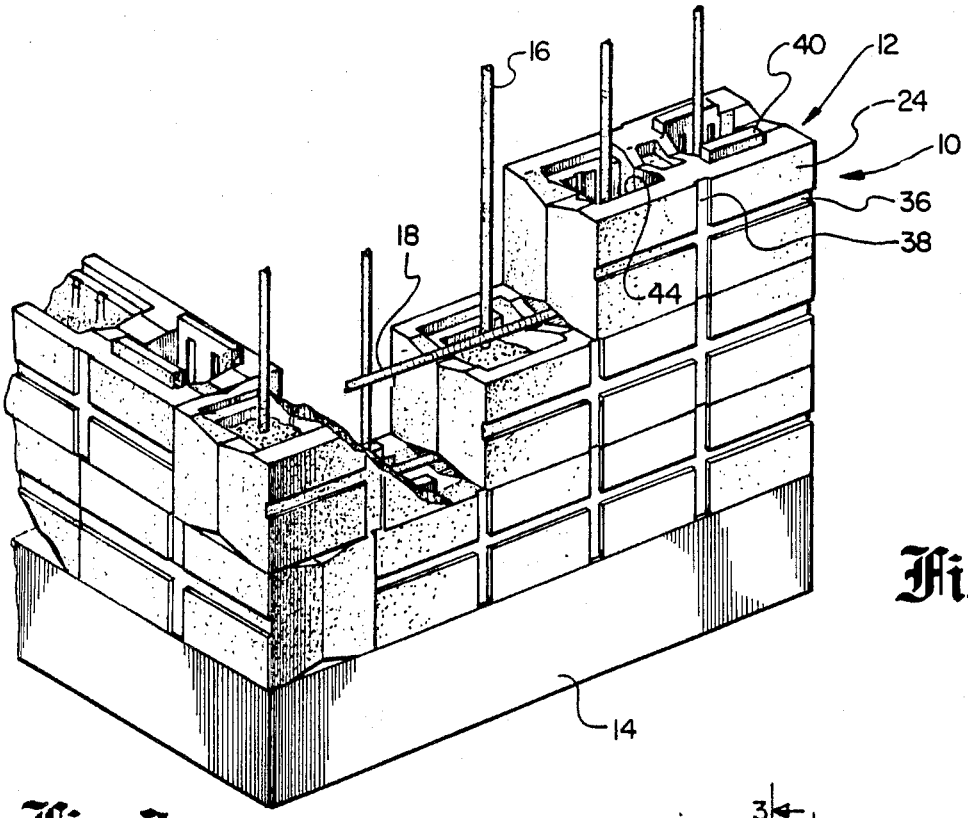
Fig.1.
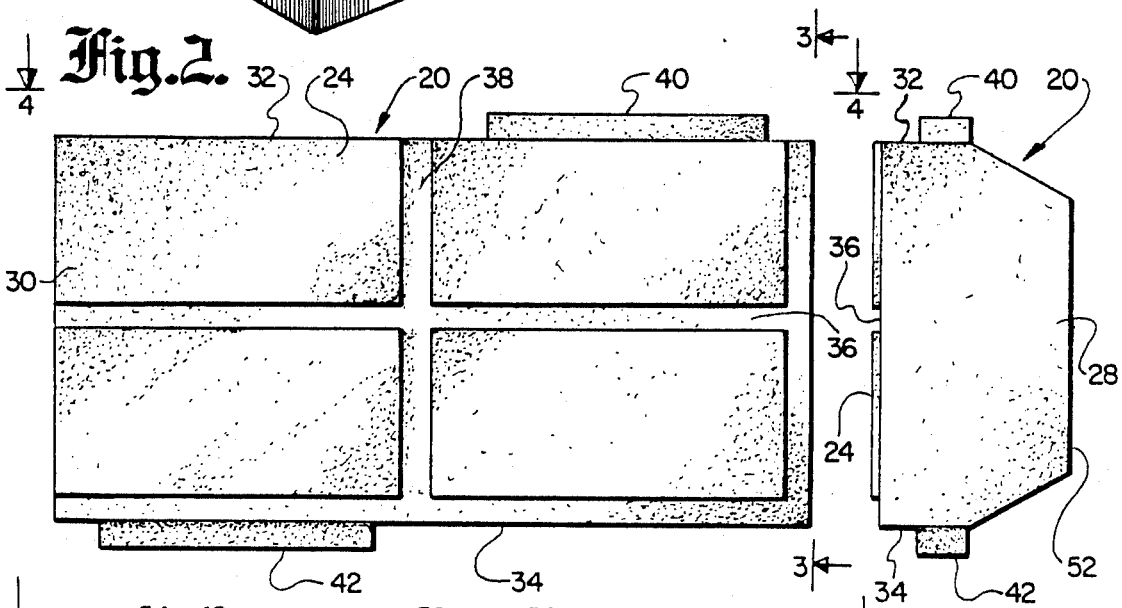
Fig.2.
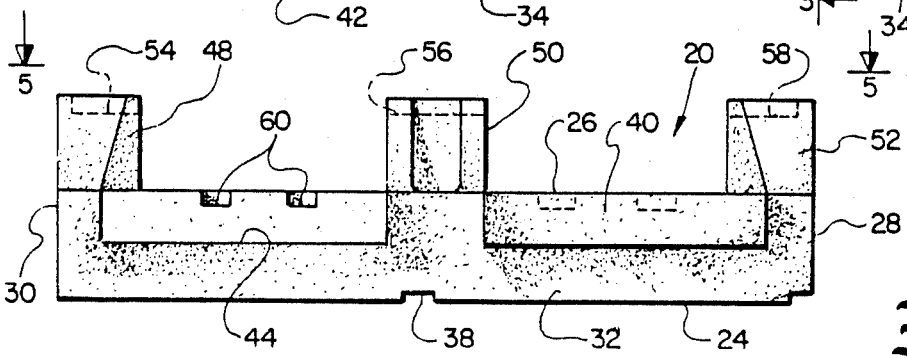
Fig.3.
Fig.4.

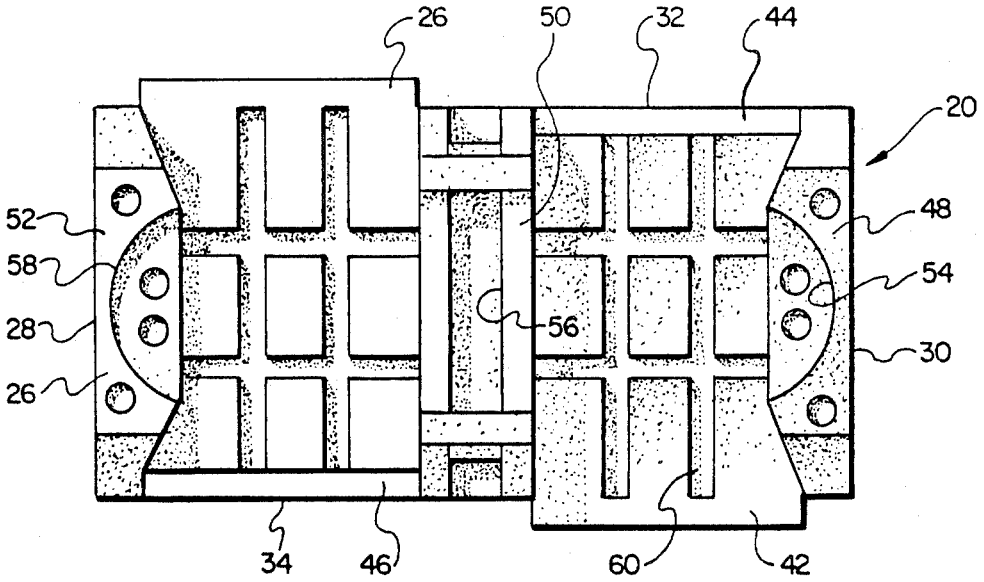
Fig.5.
Fig.6.
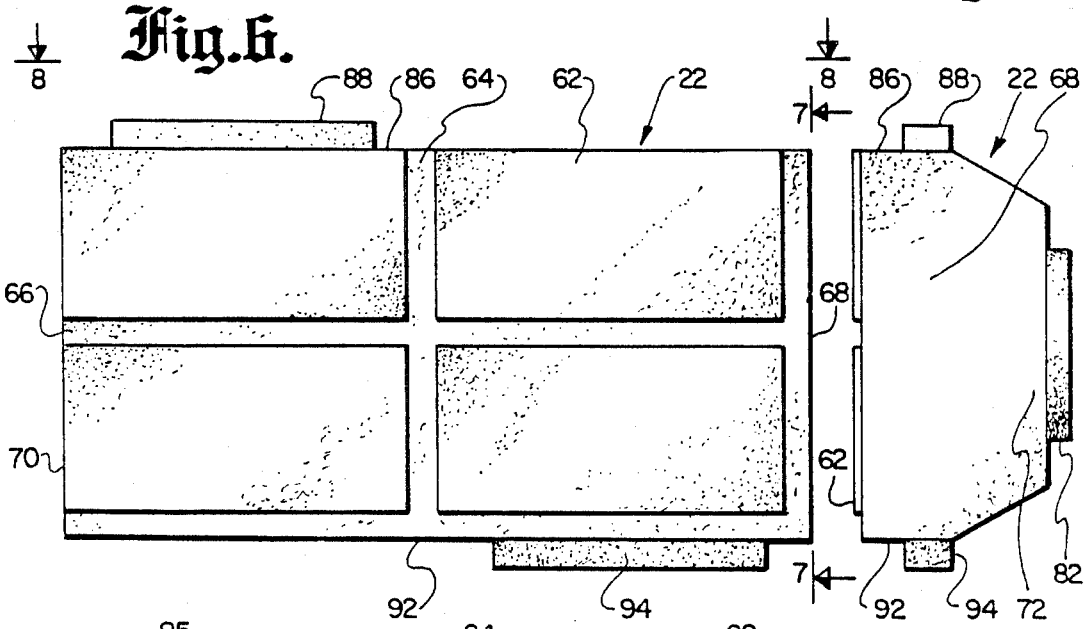
Fig.7.
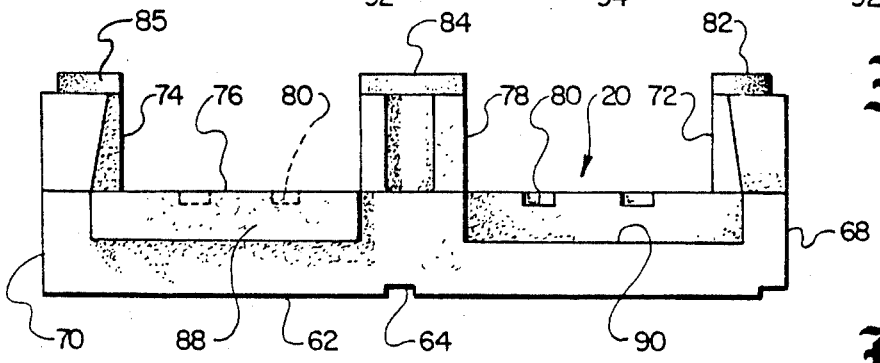
Fig.8.

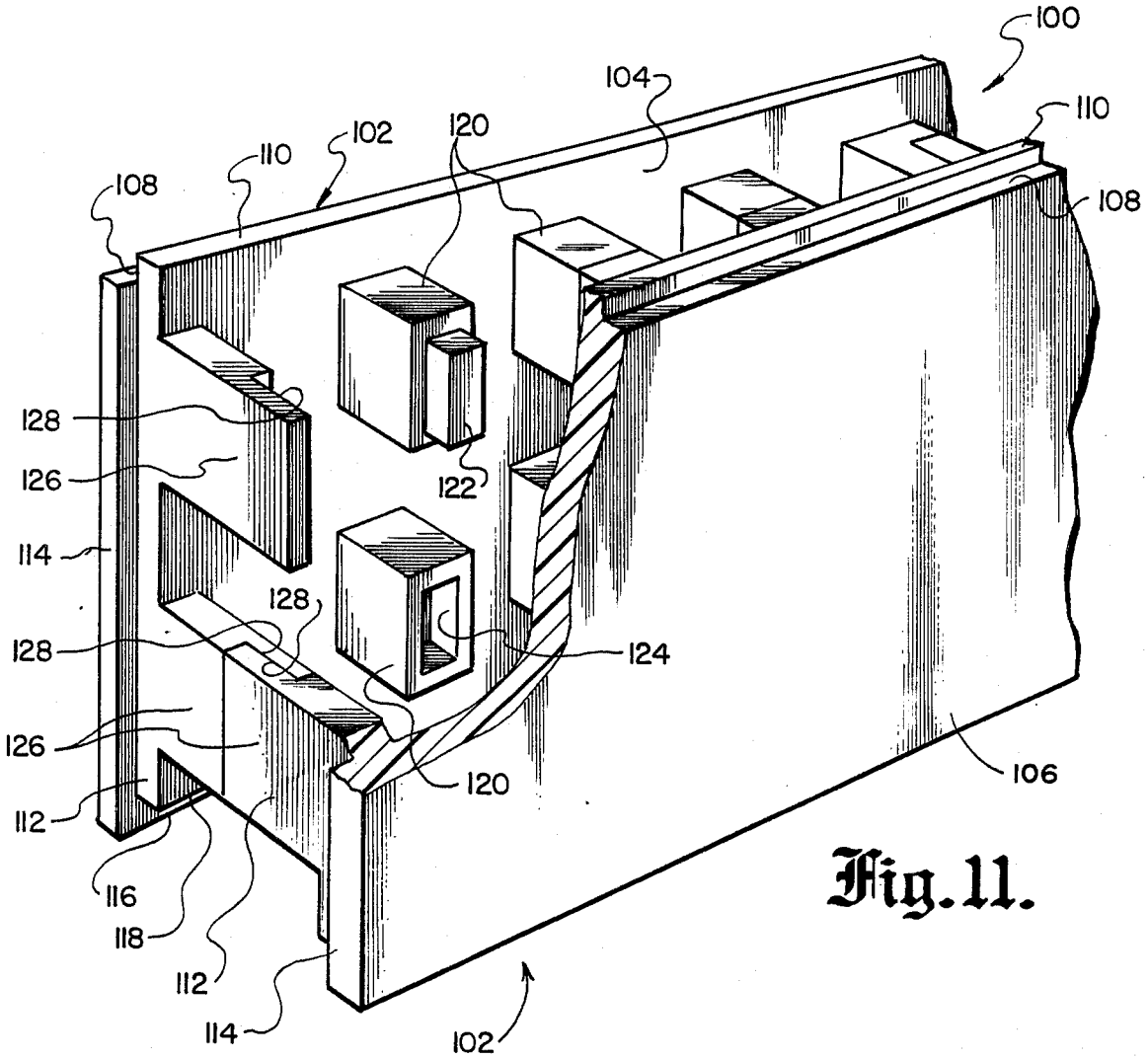
Fig. 11.
Fig. 12.
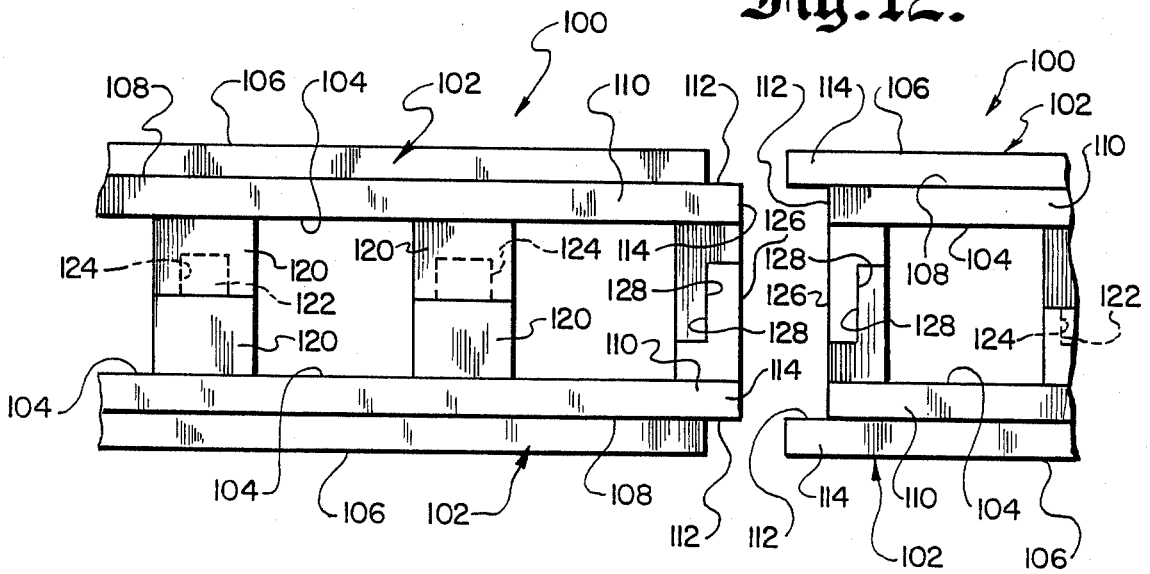

CONSTRUCTION BLOCK

REFERENCE TO PRIOR APPLICATION

This patent application is a continuation-in-part of patent application Ser. No. 310,797, filed Oct. 13, 1981, by the same title and by the same inventor.

BACKGROUND OF THE INVENTION

The field of this invention relates to the construction of houses, buildings and the like, and more particularly to a new and novel building block to be utilized in the construction of houses, buildings and the like.

The customary manner of constructing a building or a house, if it is to be formed of bricks or concrete blocks, is by utilizing a layer of mortar over the top and over the sides of the block and then positioning of blocks in a horizontally in-line manner and vertically stacked on top of each other. One row of blocks is to be horizontally staggered with respect to the next row of blocks, and so forth. This general manner of assemblying blocks is a time tested method of construction, upon which few improvements have been made. This method of building is time consuming, requiring a certain amount of special skill and experience by the individuals doing the construction.

The using of masonry (bricks and concrete blocks) in the constructing of buildings and houses has certain disadvantages. One well known disadvantage is that it is a relatively poor insulator. This means that during times of hot weather, heat is transmitted through the blocks into the interior of the building and in times of cold weather, the reverse is also true. As a result, heating and cooling costs for the interior of the constucted building are not as low as they could be.

Additionally, concrete and brick are known to be rather porous. Moisture can readily pass through the building from the exterior to the interior. This is not only undesirable from a humidity point of view, but also the collected moisture on the inside of the building can be damaging to interior surfaces.

Another disadvantage of bricks and concrete is their weight. Such masonry is inherently heavy and therefore not only requires that the mason be of a physical strength to be able to manipulate the masonry blocks, but also the cost of transporting the masonry blocks to the job site is substantially increased.

At the present time, there are known a substantial number of different materials which were not available only a few years ago. The use of such materials has not been incorporated in the building construction field. It would be desirable to construct a building block which is light in weight, relatively inexpensive, has good thermally insulative qualities, and could be utilized at the job site by individuals of limited special skill.

SUMMARY OF THE INVENTION

The structure of this invention relates to a building block which is to be constructed substantially in the shape of a conventional building block. In other words, the basic shape of each surface of the building block is rectangular. The building block is to be utilized with other similar blocks to be located in a vertically arranged stacked relationship. The blocks are to be arranged in a plurality of rows with each row being constructed of a plurality of horizontally disposed, in-line blocks. Each row is to be staggered with respect to each other. Each block includes a pair of enlarged interior openings which connect between the top and bottom surfaces of the building block. These openings are to provide for the including of vertically oriented rigid reinforcing rods to extend from the footing, upon which the blocks are located, and through the vertically stacked blocks. Within both the top surface and the bottom surface of the blocks are located recesses. These recesses are to provide for the including of horizontally disposed rigid reinforcing rods, which will normally be generally tied to the vertically disposed reinforcing rods. Also included within the top surface and the bottom surface of each block are a pair of protuberances and a pair of recesses. The protuberances of one block are to matingly interlockingly fit within recesses of another block so that the blocks are interlocked together. During assembling of the blocks, the blocks are to be adhesively secured together. Also, for the purpose of adding weight and overall strength, masonry cement in liquid form is to be filled within the interior openings of the block. The masonry cement is to then harden, forming, in essence, a series of vertical posts which are reinforced with the reinforcing rod about which are located the expanded polystyrene blocks.

The primary objective of the building block of this invention is to utilize a building block which can be manufacturered inexpensively, is light in weight, can be assembled by individuals with minimal special skill, is thermally insulative and non-porous to prevent the conducting of moisture therethrough.

BRIEF DESCRIPTION OF THE DRAWINGS

FIG. 1 is an isometric view showing a portion of a wall which has been constructed of the building block of the present invention;

FIG. 2 is a front view of the front section of the building block of this invention;

FIG. 3 is a right side view of the front portion of the building block of this invention taken along line 3—3 of FIG. 2;

FIG. 4 is a top plan view of the front section of the building block of this invention taken along line 4—4 of FIG. 2;

FIG. 5 is a rear view of the front section of the building block of this invention taken along line 5—5 of FIG. 4;

FIG. 6 is a view similar to FIG. 2, but of the rear section of the building block of this invention;

FIG. 7 is a right side view of the rear section of the building block of this invention taken along line 7—7 of FIG. 6;

FIG. 8 is a top plan view of the rear portion of the building block of this invention taken along line 8—8 of FIG. 6;

FIG. 11 is an isometric view, partially cut away, of a modified form of building block of this invention;

FIG. 12 is a top plan view of portions of two separate building blocks of FIG. 11 showing such slightly spaced from each other and about to be connected together in a normal edge connecting relationship;

DETAILED DESCRIPTION OF THE SHOWN EMBODIMENT

Figure 9:
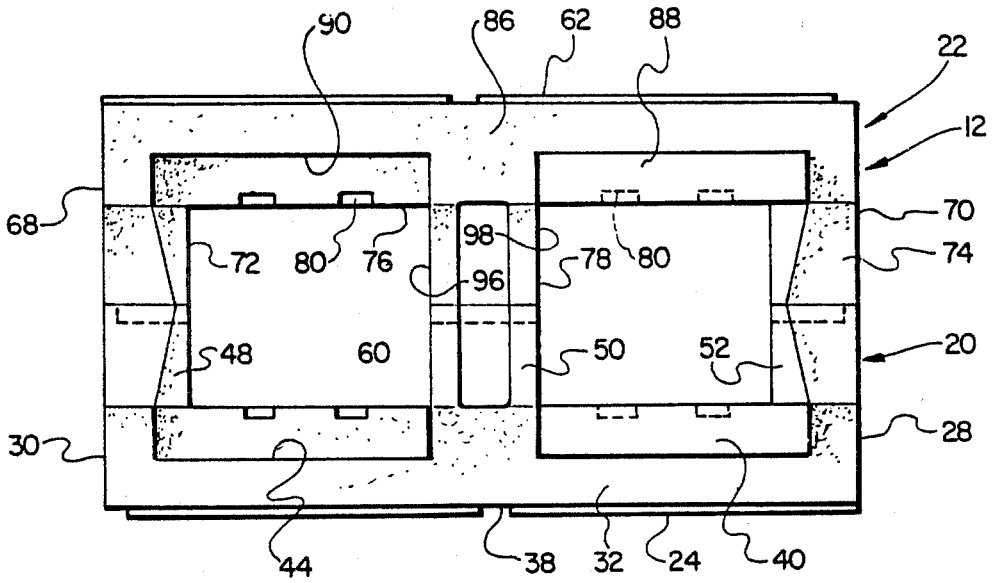
FIG. 9 is a top plan view of both the front section and the rear section assembled together forming the building block of this invention.
Figure 10:
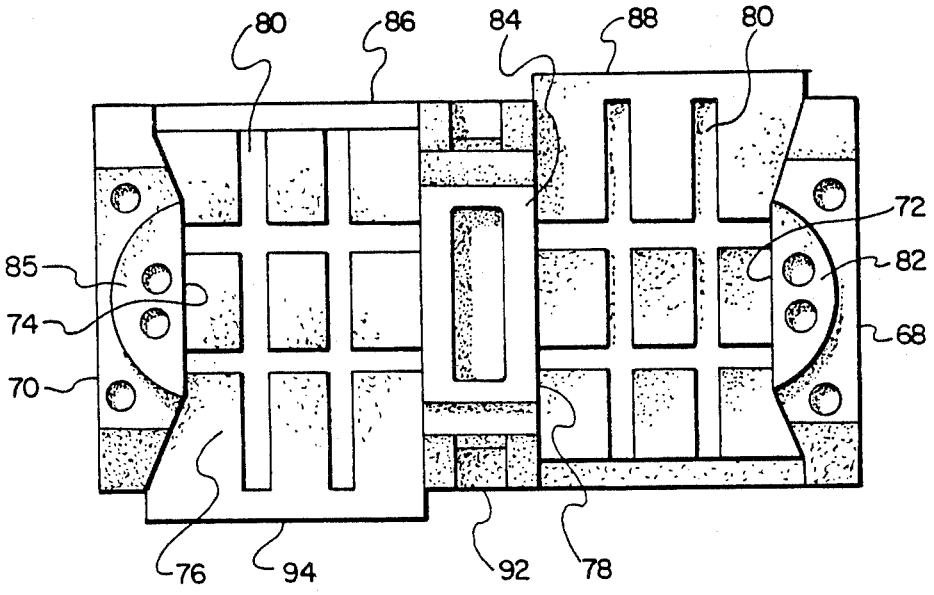
FIG. 10 is a rear view of the rear section of the building block of this invention.

Referring particularly to the drawings, there is shown a wall 10 which is constructed in a conventional manner utilizing the building block 12 of this invention. The conventional manner utilizes the preforming of a masonry cement footing 14 upon which there is located a first layer of rows of the building blocks 12 which are located in a horizontally arranged, in-line manner. It is to be noted that in referring particularly to FIG. 1 that a corner section is shown so that the in-line direction of the bottom layer of building blocks 12 actually constitutes two separate directions meeting at a right angle. Upon the first, or lower, layer of the building blocks 12, there will be located a second layer of building blocks 12, a third layer, and so forth. It is to be understood that each subsequent layer of building blocks 12 will be staggered with respect to abutting layers.

Cemented into the footing 14 will be located a plurality of vertically disposed reinforcing rods 16. Normally there will also be utilized a series of horizontally disposed reinforcing rods 18 which will be located at the junction between rows of the building blocks 12. The reinforcing rods 16 and 18 will normally be constructed of metal, such as steel.

The material of construction for the building block 12 is to be a plastic material. The preferable type of plastic is what is referred to as expanded polystyrene beads. A precise quantity of the beads are to be shot into an enclosed mold cavity and upon the application of heat, expand filling the cavity. The result is that a building block 12 is produced which is substantially light in weight and is of sufficient strength in order to produce a wall, such as wall 10. As an example, an eight inch by eight inch by sixteen inch building block of this invention, constructed of expanded polystyrene beads will weigh approximately nine ounces. A similar masonry block will normally weigh thirty to forty pounds.

The building block 12 is to be constructed of a first section 20 and a second section 22. Each of the sections 20 and 22 are substantially identical, except for minor changes which will become apparent further on in the description.

The front section 20 is formed into a front surface 24, a back surface 26, side walls 28 and 30, a top surface 32 and a bottom surface 34.

The front surface 24 includes an elongated, horizontal groove 36 and a centrally located vertical groove 38. As a result, the front surface 24 is made to resemble a brick surface. In some installations, this brick surface can be merely painted, which would be the only finishing that would be required.

The side surfaces 28 and 30 are substantially planar. Both the top surface 32 and the bottom surface 34 are also substantially planar with the exception being that there is an elongated protuberances 40 extending outwardly from the top surface 32 and a similar elongated protuberance 42 extending outwardly from the bottom surface 34. It is to be noted that the protuberance 40 and 42 are located in a staggered relationship with respect to each other, but do not overlap in the vertical direction in respect to each other. In other words, protuberance 40 is directly adjacent the side surface 28, with the protuberance 42 being located directly adjacent the side surface 30.

Also formed within the top surface 32, but located directly adjacent the side surface 30, is an elongated recess 44. A similar elongated recess 46 is formed within the bottom surface 34 located directly adjacent the side surface 28. It is to be noted that the size of the recesses 44 and 46 is identical in volume and dimensions to the size of the protuberances 40 and 42.

Extending outward from the back surface 26 are three in number of upstanding projections 48, 50 and 52. The exterior wall of the projection 52 is flush with the surface 28. Similarly, the exterior wall of the projection 48 is flush with the surface 30. The projection 50 is evenly spaced between the projections 40 and 52.

Formed within the projection 48 is a recess 54. The recess 54 comprises a segment of a circle. A rectangularly shaped recess 56 is formed within the projection 50. A partial circular shaped recess 58 is formed within the projection 52.

Formed within the surface 26 are a series of grooves 60. The function of the grooves 60 will be explained further on in the specification.

Referring particularly to FIGS. 6–8 of the drawings, there is shown the back section 22. The back section 22 has rear surface 62, which is divided into a similar brick shape by means of grooves 64 and 66. The back section 22 has side surfaces 68 and 70, which are respectively flush with the exterior surface of the projections 72 and 74, which extend from the back wall 76. Also extending from the back wall 76 is a centrally located projection 78. Formed within the back wall 76 are a plurality of grooves 80. Extending outward from the projection 72 is a protuberance 82, with a protuberance 84 extending outward from the projection 78 and a protuberance 85 extending outward from the protuberance 74.

Formed within the top surface 86 is an elongated protuberance 88. Also formed within the top surface 86 is an elongated recess 90. Extending outward from the bottom surface 92 is an elongated protuberance 94. Also formed within the bottom surface 92 is an elongated recess (not shown).

In the forming of the block 12, the rear section 22 is to be located in a facing position with the front section 20 substantially as shown in FIG. 9 of the drawings. An adhesive of any satisfactory type is to be applied within the recesses 54, 56 and 58. Similar adhesive is to be applied upon the protuberance 82, 84 and 85. Also, an adhesive is to be applied to any connecting surfaces, such as the surfaces located directly about the protuberances 82, 84 and 85. At this time, the protuberances 82, 84 and 85 are causes to snugly mate within their respective recesses 54, 56 and 58. The adhesive is then permitted to dry, which will result in the forming of a solid integral unit substantially as shown within FIGS. 1 and 9.

As each row of the building blocks 12 are assembled, there is adhesive to be applied to the ends formed by flush surfaces 28 and 70 and flush surfaces 30 and 68. Also, adhesive will be applied to the flush bottom surfaces 34 and 92 and to the flush top surfaces 32 and 86. When starting the second row above the footing 14, it is to be understood that the protuberances 42 and 94 are to cooperate within respective recesses 44 and 90 of another block resulting in the second block being located in a staggered condition with the first block. This situation is to be maintained for each row of the blocks 12 which is mounted on top of another row of blocks 12.

As each row of the building blocks 12 are stacked on top of another row, masonry cement in liquid form will be inserted within the enlarged openings 96 and 98. The openings 96 and 98 are formed between the aligned projections 48 and 72, the aligned projections 50 and 78 and the aligned projections 52 and 74. This cement secures the reinforcing rods 16 and also secures to the building block 12, filling the grooves 60 and 80. As a result, an extremely solid integral unit is constructed in the forming of the wall 10.

Referring particularly to FIGS. 11 through 15, there is shown a modified version 100 of the building block of this invention, which is composed of two in number identical, half members 102 which are mounted together in a reversed facing relationship. Each half member 102 includes a back wall 104 and a front wall 106. Each front wall 106 is substantially smooth. However, it is considered to be within the scope of this invention that any textured surface could be formed within the front wall 106.

Formed within the upper edge, or top wall, of each half member 102 is an elongated open ended recess 108, which is bordered on the inside surface thereof by an elongated protuberance 110. The protuberance 110 is integral with the back wall 104. It is to be noted that the side wall, or side edges, of the half member 102 includes an open-ended recess 112 located directly adjacent the back wall 104 and elongated ridge 114 located directly adjacent the front wall 106. It is to be noted that on the opposite side of the half member 102, the ridge 114 and the recess 108 are interchanged so that an end of one building block 100 will interlockingly engage with an end of another building block 100, such as shown in FIG. 12 of the drawings.

It is further to be noted that the bottom surface of the lower edge of the half member 102 includes an elongated ridge 116 and an elongated recess 118. Again, the ridge 116 and the recess 118 are reversed in respect to the ridge 110 and the recess 108. This is to permit the bottom edge of a building block 100 to interlockingly matingly engage with an upper edge of another building block 100. In essence there are formed two parallel, spaced-apart, ridges 110 within the top wall which snugly connects with the pair of recesses 118 formed within the bottom wall of another building block 100.

The back surface 104 of each half member 102 includes a plurality of upstanding members 120. Some members 120 include an outwardly extending polygonal shaped protuberance 122, while others include a polygonal shaped protuberance receiving recess 124. With the half members 102 located in their facing relationship, it is to be noted that a protuberance 122 is to fit in a close fitting manner within a recess 124. It is to be understood that there will be adhesive smeared within each recess 124 and also about the surface of each protuberance 122 so as to secure together the half members 102. Located between each directly adjacent connected pair of upstanding members 120 is an opening. Therefore, a plurality of openings are formed within each building block 100 and each opening is open between the upper edge and the bottom surface of the building block 100. It is to be understood that, similar to building block 12, masonry cement (as opposed to plastic cement) is to be poured into and fill these openings and when hardened provide the strength for the wall structure produced by the assemblage of building blocks 100.

The upstanding members 126 are formed of a thickness which is approximately one half the thickness of each of the members 120. This is so that when a building block 100 abutts an edge of another building block 100, that the upstanding members 126 of one building block 100 will connect with (and adhesively secured to) a member 126 of the abutting building block 100. The result is an upstanding member is now formed which is of a width equal to each of the upstanding members 120. It is to be noted that the height of each of the members 126 is identical to the height of each of the members 120.

Each upstanding edge member 126 includes a cut-out area 128. It is to be noted that the cut-out area 128 formed within one member 126 is reversely positioned with respect to the member 126 located on the same side edge of the block 102. This is so that when the half members 102 are connected together, the upstanding edge members 126 will interlockingly engage together in a close fitting relationship with a layer of adhesive being located therebetween.

Figures 13, 14, 15:
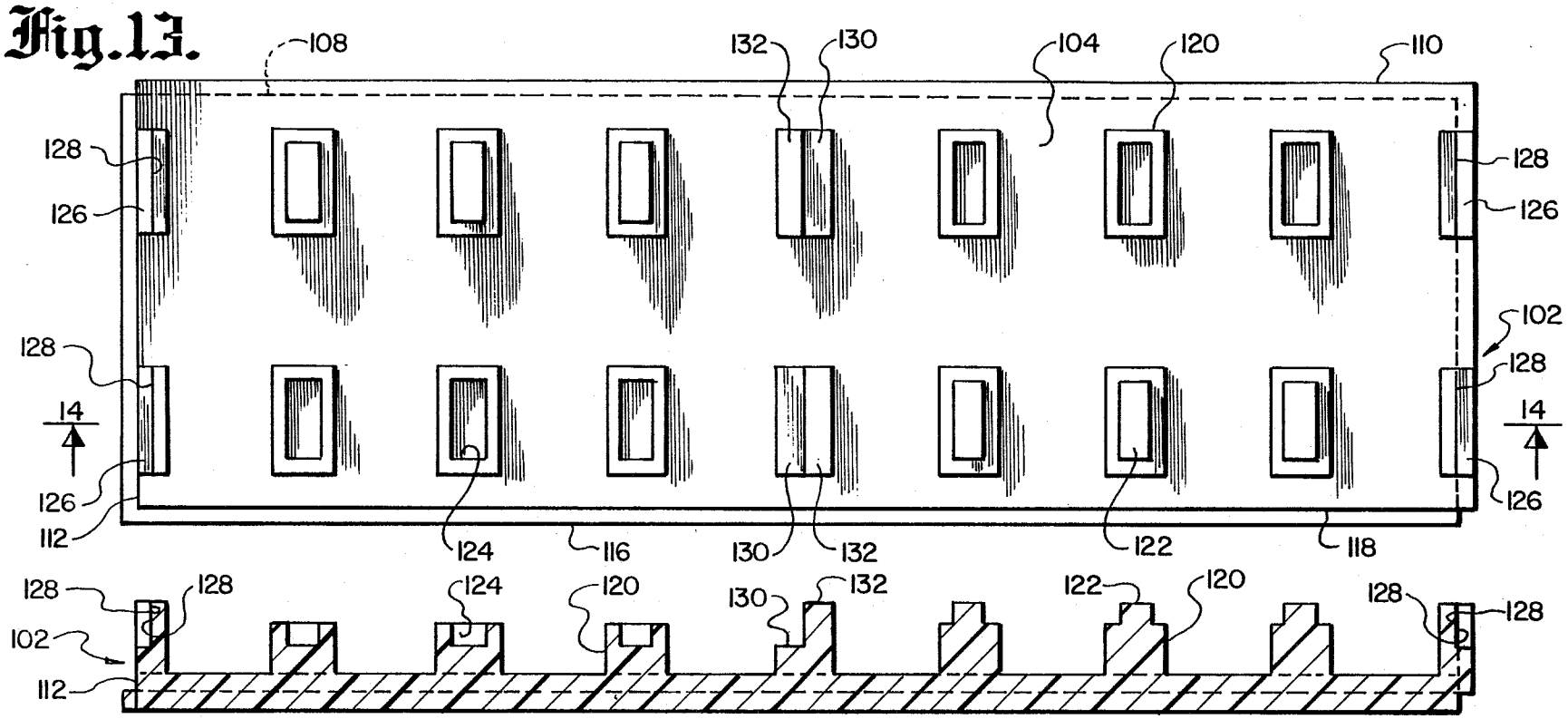
FIG. 13 is an inside, rear, elevational view of one of the two identical sections which are assemblied together in a facing relationship to produce the modified form of the building block of FIG. 11.
FIG. 14 is a bottom plan view of the section of building block shown in FIG. 13 taken along line 14—14 of FIG. 13.
FIG. 15 is a bottom plan view similar to FIG. 14, but of the building block of FIG. 11.

It is to further be noted that referring particularly to FIG. 13 of the drawings, that the members 120, which are centrally disposed with respect to the width of the half member 102, are each divided to include a half recess 130 and a half protuberance 132. It is to be noted that the half recesses 130 are reversed in position within the other centrally located upstanding member 120. In a similar manner, the protuberance 132 is reversely positioned. This is so that when the half members 102 are located in their abutting, facing relationship, a protuberance 132 is to engage within a recess 130 of both the centrally located upstanding members 120.

What is claimed is:

1. A construction building block formed of a lightweight, molded plastic material comprising:

a pair of half members, one of said half members being located in a reversed facing relationship relative to the other said half member forming therebetween an opening assembly, said half members being identical, said half members forming a front wall and a back wall and a top surface and a bottom surface, said front wall being connected to said back wall by a pair of spaced apart side walls, said top surface and said bottom surface and said side walls forming a peripheral edge of said construction building block; and first interlocking means connected to said back wall, said first interlocking means of said one half member interlockingly matingly engaging with said first interlocking means of the other said half member, said first interlocking means being composed of a plurality of upstanding members, said first interlocking means being located within said opening assembly, said upstanding members comprising a plurality of connected pairs, each said connected pair including a polygonal shaped male member and a polygonal shaped female member with the said male member adhesively matingly engaging with its respective said female member, said opening assembly forming a plurality of openings between said connected pairs of said upstanding members, said openings extending between said top surface and said bottom surface, upon said building block being located in a vertically orientated stacked relationship said openings between vertically joined said building blocks forming a plurality of separate openings adapted to accommodate a quantity of poured masonry cement which when hardened provides the necessary strength for a wall structure produced by said building blocks.

2. The construction building block as defined in claim 1 wherein:

second interlocking means formed entirely along said peripheral edge, said second interlocking means including a pair of spaced-apart parallel ridges formed on said top surface and a pair of spaced-apart parallel recesses formed within said bottom surface, said opening assembly being located between said ridges and said recesses, said second interlocking means comprising a continuous series of said ridges and said recesses, said ridges of one said building block interlockingly engaging with the said recesses of another said building block.

3. The construction building block as defined in claim 2 wherein:

said separate openings defining a plurality of horizontal openings and a plurality of vertical openings to accommodate the flow of the masonry cement mixture.

* * * * *